United States Patent [19]

Ditges

[11] 4,078,407

[45] Mar. 14, 1978

[54] RESHAPING OF COMPONENTS OF DUCTILE MATERIALS

[75] Inventor: Günter Ditges, Rodenkirchen-Weiss, Germany

[73] Assignee: Meyer, Roth & Pastor Maschinenfabrik GmbH, Cologne, Germany

[21] Appl. No.: 670,377

[22] Filed: Mar. 25, 1976

[30] Foreign Application Priority Data

Mar. 26, 1975 Germany ..... 2513329

[51] Int. Cl.[2] ..... B21D 11/00

[52] U.S. Cl. ..... 72/19; 72/30; 72/33; 72/378; 72/702

[58] Field of Search ..... 72/7, 19, 21, 22, 26, 72/30, 378, 702, DIG. 22, 33

[56] References Cited

U.S. PATENT DOCUMENTS

| | | | |
|---|---|---|---|
| 2,945,547 | 7/1960 | Bower et al. | 72/33 |
| 3,156,287 | 11/1964 | Munro | 72/702 |
| 3,777,525 | 12/1973 | Peddinghaus | 72/22 |

*Primary Examiner*—Lowell A. Larson
*Attorney, Agent, or Firm*—Spencer & Kaye

[57] ABSTRACT

In order to accurately control a process in which a structural component of ductile material is subjected to a change in shape by the application of a progressively increasing deformation force while measuring the resulting deformation, the measured deformation is employed to derive a representation of a nominal deformation force which varies as a predetermined function of deformation over a selected deformation range, the representation is compared with the applied deformation force, and the application of the deformation force is terminated upon arriving at a deformation amount for which the applied deformation force coincides in value with the nominal deformation force.

7 Claims, 6 Drawing Figures

RESHAPING OF COMPONENTS OF DUCTILE MATERIALS

BACKGROUND OF THE INVENTION

The present invention relates to a reshaping process for structural components made of ductile, particularly metallic, materials, and particularly to the control of such a process.

For a number of purposes, semifinished objects or structural components are deformed beyond their elastic limit under the influence of deforming forces during the course of their manufacture so that, in addition to cold solidification of the material a reshaping takes place with a permanent change in geometry. For example, during the so-called calibrating of chains, the chains are stretched under load, the purpose being to stretch the chain or chain section, respectively, which is to be calibrated to a given final dimension, which final dimension is to be attained for a chain not under load. Based on the elasticity of the material, or of the component "chain", the stretching would initially have to extend beyond the given final dimension, with maximum "force" or maximum strain, and then it would be necessary to check, once the load is removed, whether the desired final dimension has been attained.

The drawback of this procedure is that the desired stretching result cannot be used directly, as a parameter in the stretching process but the stretching is always effected either at a preselected maximum force or to a preselected maximum stretched length, so that fluctuations in the characteristics of the material or in the dimensions of the material may produce stretching states which, after purely elastic relaxation, will not result dependably, reproducibly and with sufficient accuracy in the desired calibrated length. It may become necessary to repeat the stretching process at least once for all or some of the chain sections in order to arrive at the desired final dimension, the difficulty then being the maintenance of reproducible values. Added to these drawbacks in the reshaping process itself is the added expense for time and personnel.

SUMMARY OF THE INVENTION

It is therefore an object of the present invention to control such a reshaping process in a manner to attain the desired final dimension for the component being reshaped in but a single stretching process.

This and other objects of the present invention are achieved in that the reshaping deformation and the actual force value required for the reshaping are measured and that the actual value of the reshaping force is compared with a given nominal force value, the nominal value being varied as a given function of the reshaping deformation,, and once the nominal force value and actual force value coincide, the reshaping process is terminated. With the aid of this process it is possible to also reshape complicated geometrical semifinished objects or structural components in one process step so that the desired plastic changes are dependably realized.

According to one embodiment of the process of the present invention, the curve defining the nominal force value corresponds to the elastic deformation region of the stress-strain curve of the already reshaped component. This is of advantage in particular for reshaping metallic materials since the curve of the nominal force value can be measured with the aid of a test object which has been reshaped to the desired final dimension and the resulting force curve can be set with respect to elastic expansion.

In the simplest case the nominal value curve may have the form of a straight line with an angle of inclination with respect to the horizontal which corresponds approximately to the modulus of elasticity of the reshaped component.

For materials or components whose elastic behavior after reshaping is not linear, but where, due to geometrical influences the deformation diagram takes on the shape of a hysteresis loop, it is possible in a number of cases to approximate these hysteresis loops with sufficient accuracy by means of a straight line whose points represent average values.

For components for which, due to the material employed and/or the geometry of the component, a nominal value curve in the form of a straight line would be disadvantageous, it is advisable to reproduce the actual curve for the increase in the nominal force value as a function of the deformation amplitude with the aid of appropriate known electronic devices with digitally or analog controlled elements to thus obtain an accurate comparison between the nominal and the actual values.

In an advantageous embodiment of the process of the present invention, the zero point of the nominal force value with reference to the force-deformation, or stress-strain, diagram of the component being tested is shifted along the deformation axis by an amount equal to the distance of the nominal dimension from the starting dimension of the component. This produces an unequivocal association of nominal value and actual value, appropriate apparatus design providing for the automatic actuation of the start of the change in the nominal value. If now, again with the appropriate apparatus, the switching operation which is to occur upon coincidence between nominal value and actual value of the deformation force is also made automatic, the process of the present invention provides a fully automatic sequence which permits the reshaping of a large number of identical components, for example calibrating a chain of any desired length in sections of identical length.

The present invention further relates to an apparatus for carrying out such a procedure in a reshaping device which employs a dynamometer for measuring the actual value of the deformation force and an extensometer for observing the progressive expansion.

A device of this general type is disclosed for the manufacture of calibrated and tested chains in German Pat. No. 920,284. However, this device operates with the above-described drawbacks.

Apparatus according to the present invention, however, makes possible a fully automatic reshaping device in that, according to the invention, the extensometer is connected to an elongation signal function generator which is connected with an adjustable generator to provide the variable nominal value for the deformation force and that the dynamometer and the nominal value generator are connected with a comparator which acts on a switch to stop the reshaping device.

In a modified form of construction, the force generator may cooperate with a transducer which, in conformance with the assumed elastic constant of the material being stretched, furnishes force proportional deformation signals in a form comparable to the signals furnished by the derormation signal generator for a zero comparison during the stretching process.

In a further embodiment of the invention, the deformation signal generator is provided with a settable actuation device to switch on the nominal value generator. Thus it is possible to reshape, with the aid of the apparatus of the present invention, structural components which have an identical elastic behavior in the deformed state but which have different final dimensions upon deformation under load. Such a deformation dependent actuating device can be assembled in a simple manner from currently known mechanical, electrical, electronic or even hydraulic or pneumatic switching means, the advantage being that once the curve for the nominal value is determined in the nominal value generator it need not be changed.

The entire apparatus may be constructed of appropriate known electrical, electromechanical, electrohydraulic or hydraulic-mechanical, or similarly acting measuring value sensors, comparators and switches. In a particularly advantageous embodiment of the invention, for an apparatus which is subjected to the rough shop operation of a production plant, for example in a plant for producing calibrated and tested chains, the dynamometer for the actual value acts on a pivotal lever which is provided with a displaceable contact element, and the nominal value generator acts on a displaceable contact arm whose path of movement intersects the pivot circle of the lever. Such an embodiment permits the use of mechanical devices for measuring the force and, on the other hand, employs only mechanical means for reproducing the nominal value curve so that the apparatus as a whole operates practically independently of temperature and is not subject to malfunctions even in the rough shop operation of a production plant.

The process of the invention will be described in detail with reference to a rod-shaped component made of steel.

DESCRIPTION OF THE PREFERRED EMBODIMENTS

Figure 1:
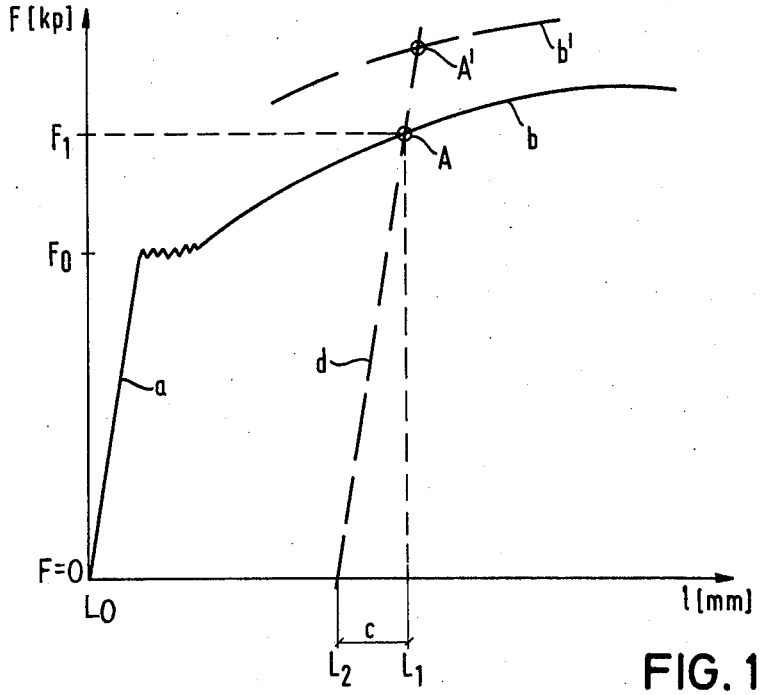
FIG. 1 is a diagram used to explain the process of the present invention.

FIG. 1 shows the stress-strain curve produced when a rod-shaped body of steel is stretched, the ordinate of the curve showing the stretching force F and the abscissa representing the resulting elongation L. When the tensile force $F_0$ is exceeded, the curve region *a* conforming to Hooke's law will be passed and the curve changes to the region *b* of permanent deformation. If the stretching force is now increased to $F_1$, the length of the rod will increase to a value of $L_1$, compared to its unstressed length. If the rod is now completely relaxed, i.e. if the tensile force F is completely removed, its length will decrease slightly, due to its elastic properties, by a certain amount *c* so that the remaining permanent deformation of the rod is only $L_1 - c = L_2$. If point $L_2$ on the abscissa is connected with point A on curve region *b* of the diagram, a straight line *d* results which is approximately parallel to the region *a* of the curve.

If it is now intended to stretch a plurality of identical rod-shaped components to the dimension $L_2$, it is necessary to bring the bodies which are initially of length $L_0$ to the dimension $L_1$ with the aid of a force $F_1$ so that, after relaxation, the desired nominal length $L_2$ will result. Since, however, in practice the materials are not perfectly homogeneous and are not identical to the degree required to enable such a process to be performed repeatably, it is impossible to operate with a constant, given deformation force since this would produce different nominal lengths due to the inhomogeneities in the elasticity of the various materials or components, respectively.

Figure 2A:
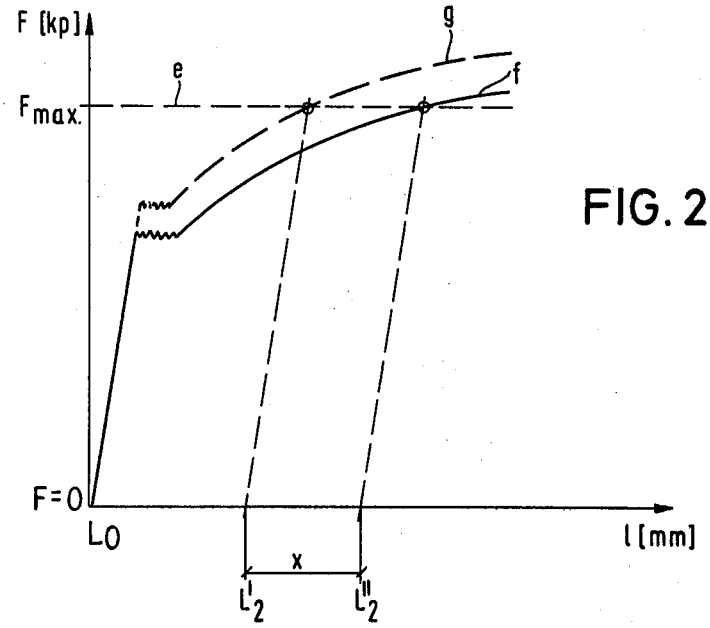
FIGS. 2*a* and 2*b* are diagrams illustrating processes according to the prior art.

This is shown in FIG. 2*a* for a stretching process of the type employing "maximum force" ($F_{max}$) as the measuring value for the end of the elongation process. The given maximum force is shown by line *e*. If a series of nominally identical components with different deformation behavior, as represented by curves *f* and *g*, are involved, some of the components will be permanently reshaped after relaxation to length $L''_2$ and others to length $L'_2$. Perfect calibration is thus impossible since deviations in dimensions between the individual components cover a range *x*.

Figure 2B:
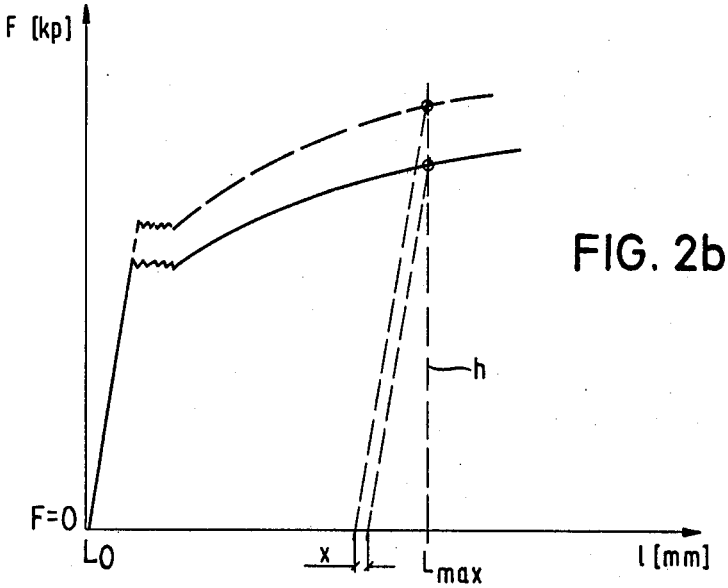

If, as shown in FIG. 2*b*, the process employs stretching with "maximum strain" ($L_{max}$) as the reference value for the end of the elongation process, shown by line *h*, the result will be practically the same. Only the range *x* of the deviations in the dimensions of the elongated parts from one another is generally somewhat smaller.

In contrast, the procedure according to the present invention operates as follows: during the elongation step, the nominal value for the deformation force increases along line *d* of FIG. 1 after the given nominal length $L_2$ has been reached, while the actual force follows the curve *a*—*b*. If the actual value and the nominal value for the deformation force F coincide, the machine is switched off. If the elongated component is now relaxed, the component will become shorter due to its elastic behavior. Since the increase in the nominal value for the deformation force as well as the reduction in the actual force upon relaxation occur along curve *d*, it is assured that the remaining, permanent, deformation will produce the nominal length $L_2$.

This also applies for the case when, due to variations in the material or differences in the geometry of the component, a higher force and a greater amount of elongation are required for the total deformation, as in the case of a material represented by curve *b'*. Here the deformation process is continued likewise until the actual value and the nominal value for the deformation force coincide, at point A', and the reshaping process is then terminated. In spite of the higher deformation force and the longer deformation path under load, the given nominal length $L_2$ will be reached upon relaxation since as a result of its elastic behavior the component will contract to the given nominal length once it is relaxed.

Figure 3:
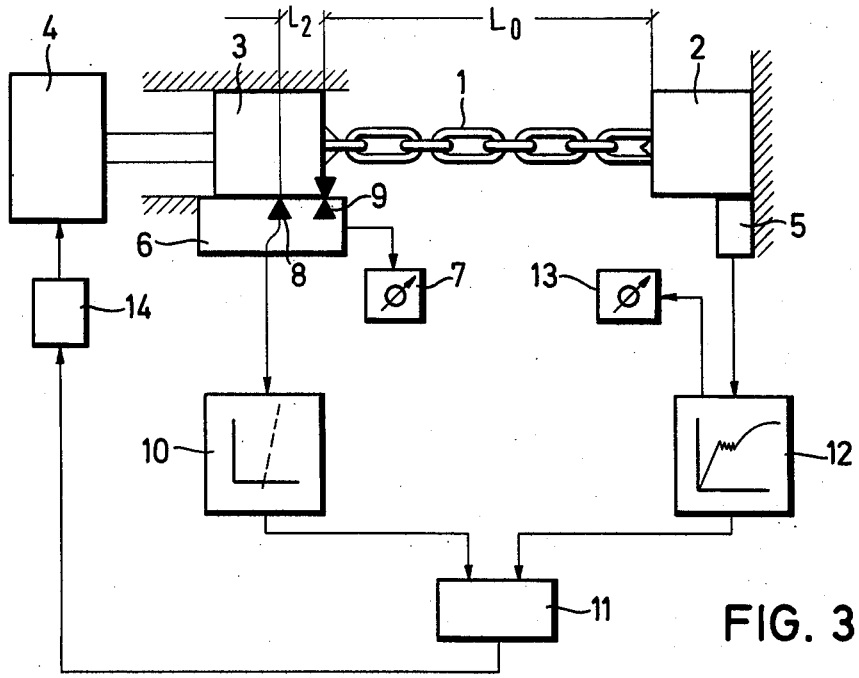
FIG. 3 is a block circuit diagram of an embodiment of apparatus according to the invention.

FIG. 3 is a schematic representation of an apparatus for practicing the method in an embodiment for calibrating chains.

The piece of chain 1 to be tested is held by a stationary clamping jaw 2 and a displaceable clamping jaw 3, jaw 3 being connected, for example, with a hydraulically operating stretching device 4 which applies a gradually increasing tensile force. The fixed clamping jaw 2 is provided with a force dynamometer 5 while the movable clamping jaw 3 is connected with an extensometer 6.

The extensometer is designed to permit continuous monitoring of the elongation path via an indicator device 7. Extensometer 6 is also provided with a settable actuator device which is illustrated schematically by a triangle 8. The distance of triangle 8 from the zero point, to be set each time for the elongation distance $L_2$ and shown schematically by a triangle 9, enables the nominal length $L_2$ for each chain test section to be permanently preset. The extensometer 6, and particularly actuator device 8, is connected to a function generator 10 which produces a signal representing the variable nominal value for the deformation force as a function of elongation beyond $L_2$. This is shown schematically by a corresponding diagram in unit 10. The signal produced by unit 10 is fed to a comparator 11.

The dynamometer 5 is connected to a signal converter 12 in which the signal emitted by the dynamometer 5 is standardized to the given values of unit 10. If necessary, an indicator 13 may be connected which indicates the stretching force presently being applied. The signal emitted by signal converter 12 is also fed to comparator 11.

The function generator 10 and the signal converter 12 are both of a generally known type, which are delivered by Harms & Wende, Hamburg: function generator 10 by type EAV8 combined with EAD1; signal converter by type EAD1.

The extensometer 6 is delivered by ELAN-Schalte type ID250.

If now, during stretching, when length $L_0 + L_1$ has been reached, the actual stretching force measured by dynamometer 5 coincides with the nominal force given by sensor 10 for the same elongation length, comparator 11 emits a signal to a control element 14 which switches off the drive for the stretching device and initiates the relaxation of the chain section.

Figure 5:
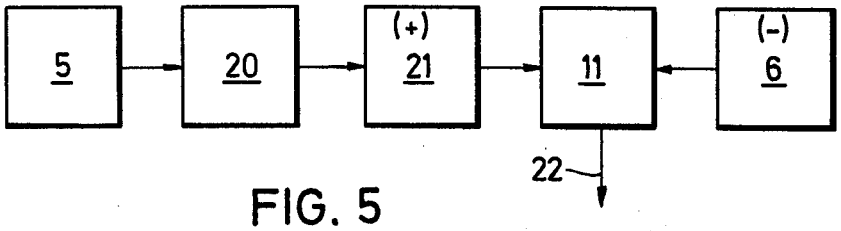
FIG. 5 is a block circuit diagram of a circuit for controlling the process sequence.

FIG. 5 illustrates, for one embodiment, the mode of operation of a device which is provided at least in part with electronic control means.

A force measuring device including a dynamometer 5 with analog-digital converter 20, furnishes a pulse to a counter 21 to increase the count by one for each unit of the increasing force. Counter 21 is a preselect counter set to count to a value which corresponds, according to the given elastic conditions, to a given elongation. As soon as this preselected number of pulses has been reached, counter 21 switches back to zero, begins a new count and transmits one pulse to comparator 11. Comparator 11 receives force-derived positive pulses from counter 21 and sums them up. As soon as, during the stretching process the desired final calibrating length $L_2$ is exceeded, comparator 11 will receive negative unit elongation pulses from extensometer 6 and these are subtracted, according to their sign, from the positive pulses. As soon as comparator 11 is thus set to zero, the maximum elongation $L_1$ has been reached and the stretching process is stopped by a switching pulse at line 22.

Figure 4:
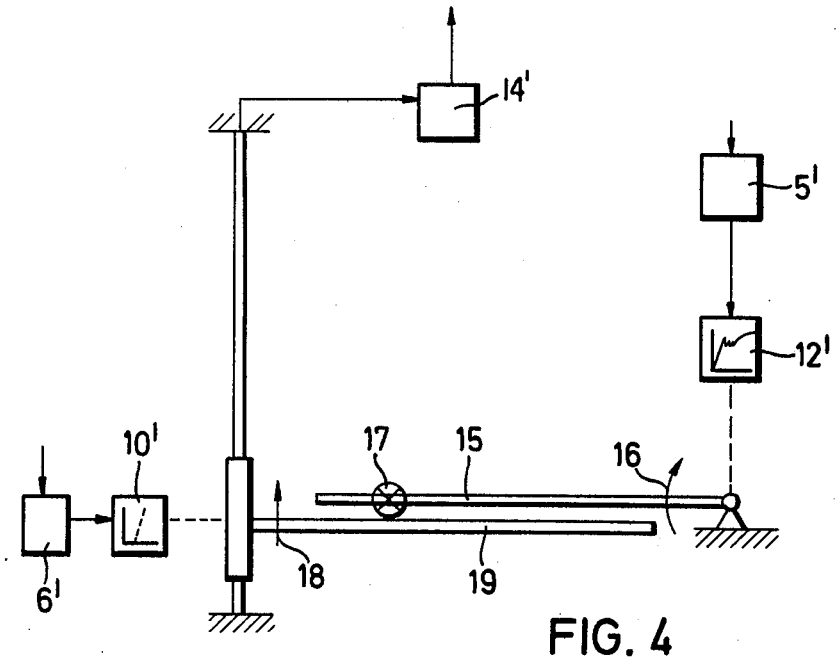
FIG. 4 is a schematic illustration of a mechanical embodiment of the apparatus of the present invention.

Whereas FIG. 3 shows a substantially electronically operating device, FIG. 4 is a schematic representation of a substantially mechanically operating embodiment of the invention. Here a dynamometer 5' acts on a signal converter 12' which acts via a mechanical coupling member or a corresponding drive motor on a lever 15 so that with increasing force the lever will be pivoted upwardly from its illustrated zero position in the direction of arrow 16. A contact element 17 is provided on lever 15 and is mounted to be positionable at any point along the length of the lever.

Extensometer 6' cooperates, via an appropriate function generator 10', with a contact arm 19 which can be displaced upwardly, in translatory movement, in the direction of arrow 18. During operation, lever 15 pivots upwardly corresponding to the actual force acting on the component to be deformed. When the given nominal deformation length $L_2$ has been reached, an actuator device in the extensometer raises contact arm 19 at a speed which corresponds to the increase in the nominal force value in dependence on the amount of elongation. Since the nominal force value increases much more steeply than the actual value, as shown in FIG. 1, contact arm 19 will touch contact element 17 when the actual force value coincides with the nominal force value so that a corresponding control pulse is actuated and the drive for the stretching device is switched off. With the displaceable contact element 17 and the corresponding setting of the speed of movement of contact arm 19 it is possible to adjust the apparatus to different materials and structures.

The drive for lever 15 and contact arm 19 may be hydraulic, pneumatic, electric or purely mechanical, depending on the type of measuring and sensing devices employed or on the type of signal converter, respectively. The speed of the contact arm may be made suitably variable if the increase in nominal value is other than linear.

The units 10' and 12' may be of the same type as the units 10 and 12 as used in the embodiment of FIG. 3.

When the contact arm 19 touches contact element 17, a control element 14', which may be similar to control element 14 in FIG. 3, will be actuated and switches off the drive unit for the stretching device and initiates the relaxation of the chain section.

The method and apparatus according to the invention have been explained above for an embodiment for calibrating link chains but are not limited thereto; they can also be used for deforming other structural components, the deformation being the result of compression, as well as tensile, forces.

It will be understood that the above description of the present invention is susceptible to various modifications, changes and adaptations, and the same are intended to be comprehended within the meaning and range of equivalents of the appended claims.

What is claimed is:

1. In a procedure for reshaping structural components of ductile materials by applying a deforming force to give each such component a final dimension having a selected value in one direction, the improvement comprising, for each such component: directly measuring the applied actual force; measuring the resulting deformation in the one direction; generating, for consecutive deformation values, a detectable representation of a nominal force value which varies as a function of deformation according to the elasticity curve characterizing the material of the component over a selected range of deformation values; comparing the nominal force value representation with the measurement of the applied actual force at consecutive deformation values; and terminating the application of the deforming force when a deformation value is reached at which the applied actual force and the nominal force have the same value.

2. A method as defined in claim 1 wherein the nominal force value varies in a manner which corresponds to the relation between the actual force and the corresponding deformation in the one direction of the reshaped structural component in its elastic deformation range.

3. A method as defined in claim 2 wherein said nominal force value varies as a function of deformation in a manner such that an extension of the representation of such variation to a nominal force value of zero provides a deformation value which corresponds to the desired final deformation of the component in the one direction after removal of the deforming force.

4. Apparatus for reshaping structural components of ductile materials by applying a deforming force to give each such component a final dimension having a selected value in one direction, comprising: means for applying a progressively increasing deforming force to such component; a dynamometer arranged for measuring the actual value of the deforming force being applied to such component and producing an output representative of the measured value; and an extensometer arranged for measuring the actual deformation experienced by such component, in the one direction, during application of the deforming force, and producing an output representative of the measured deformation value; function generator means connected to receive the output from said extensometer and to produce a detectable representation which varies in magnitude as a predetermined function of the component deformation over a selected deformation range, which function constitutes a nominal deformation force value; and comparator means connected to receive the representation produced by said function generator means and the output of said dynamometer for producing a process termination signal when the deformation of the component in the one direction reaches a value for which the values of the deforming force and the nominal force coincide.

5. An arrangement as defined in claim 4 further comprising control means connected to receive such process termination signal and halt the application of force by said force applying means upon production of said signal.

6. An arrangement as defined in claim 4 wherein said extensometer is provided with a settable actuator device for switching on said function generator when a selected deformation value has been reached.

7. An arrangement as defined in claim 4 wherein said comparator means comprises a pivotal lever provided with a displaceable contact element and connected to be pivoted in accordance with the output of said dynamometer, and a displaceable contact arm mounted to traverse a path which intersects the pivot circle of said lever and connected to be advanced in accordance with the value of the representation produced by said function generator means.

* * * * *